United States Patent [19]

English et al.

[11] 3,937,595

[45] Feb. 10, 1976

[54] ROTARY FLUID MOVING DEVICE WITH IMPROVED HUB CONSTRUCTION AND METHOD OF MAKING SAME

[75] Inventors: George A. English; Charles R. Marracino, both of Torrington, Conn.

[73] Assignee: Torin Corporation, Torrington, Conn.

[22] Filed: July 5, 1974

[21] Appl. No.: 486,110

[52] U.S. Cl. ..... 416/244 R; 416/134 R; 416/241 A

[51] Int. Cl.[2] ..... F04D 29/32

[58] Field of Search ..... 416/244, 241 A, 134

[56] References Cited

UNITED STATES PATENTS

| | | | |
|---|---|---|---|
| 2,497,242 | 2/1950 | Sprouse | 416/244 |
| 2,869,651 | 1/1959 | Rose | 416/244 X |
| 3,021,049 | 2/1962 | Settle | 416/244 X |
| 3,051,372 | 8/1962 | Rockafield et al. | 416/244 X |
| 3,376,057 | 4/1968 | Van Buren | 416/244 X |
| 3,407,882 | 10/1968 | Wooden et al. | 416/244 |
| 3,567,335 | 3/1971 | David et al. | 416/244 X |
| 3,670,382 | 6/1972 | Keehan | 29/156.8 CF |
| 3,708,243 | 1/1973 | Wooden | 416/134 |
| 3,758,231 | 9/1973 | Barnstead | 416/132 |

*Primary Examiner*—Everette A. Powell, Jr.
*Attorney, Agent, or Firm*—McCormick, Paulding & Huber

[57] ABSTRACT

An air impeller of molded plastic construction includes a plurality of similar circumaxially arranged air moving blades and a central hub section. At the hub section, a plurality of similar axially projecting flexible fingers are formed integrally and arranged in a circumaxially spaced series to form a collet which defines a cylindrical hub cavity. A metal hub of cylindrical form and apertured centrally is disposed in the cavity and has a set screw for positive connection with a drive shaft entered in its central aperture. An arcuate clamping ring disposed about the fingers urges the fingers radially inwardly into engagement with the hub and thus retains the hub in the cavity. Radially aligned gaps in the fingers and the clamping ring receive an outer end portion of the set screw to lock the hub and clamping ring against rotation relative to the fingers. Lips may be provided at outer end portions of the fingers and a radial wall at an opposite end of the hub cavity cooperates to secure the hub axially. In a second embodiment, a tongue and groove arrangement secures the hub axially in cooperation with a partial end wall formed at outer ends of the fingers. In the method of construction, the device is molded in a conventional plastic molding operation, the metal hubs are then inserted within the fingers and the clamping ring is engaged on and about the fingers, the set screw being subsequently entered in its hub opening and in the finger and clamping ring gaps when the impeller is mounted on a drive shaft.

10 Claims, 5 Drawing Figures

FIG. 1
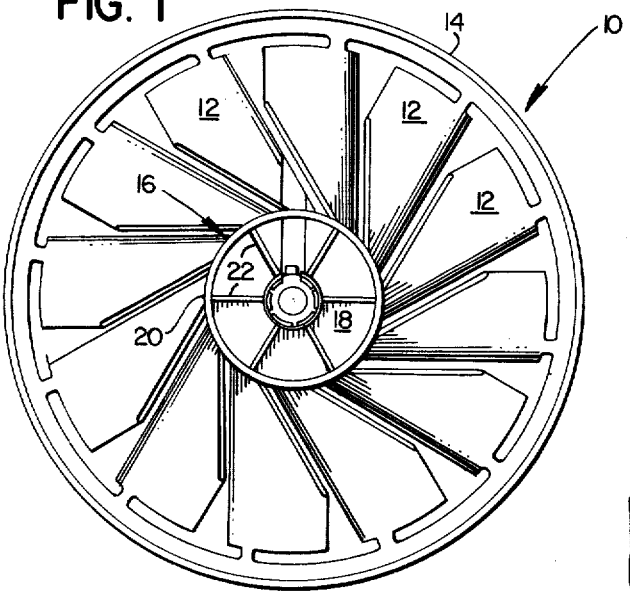
FIG. 2
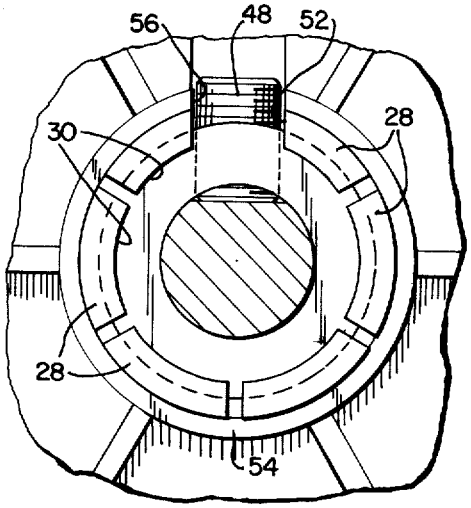
FIG. 3
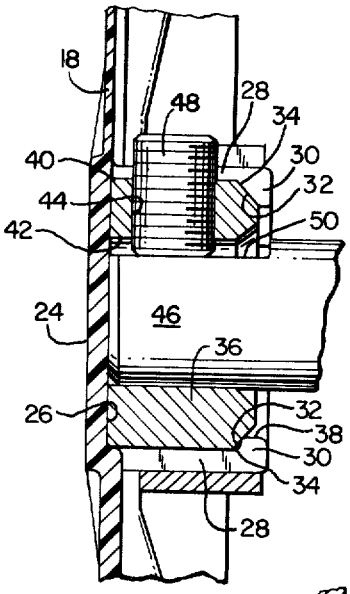
FIG. 4
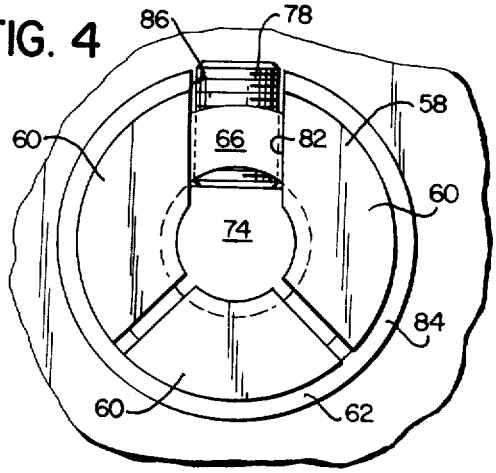
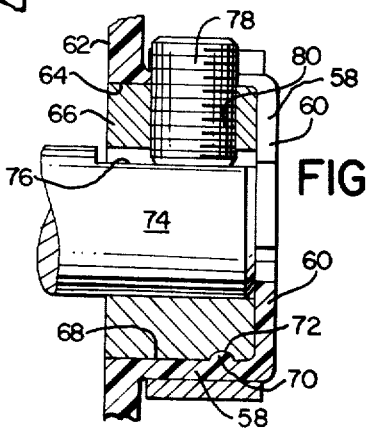
FIG. 5

ROTARY FLUID MOVING DEVICE WITH IMPROVED HUB CONSTRUCTION AND METHOD OF MAKING SAME

BACKGROUND OF THE INVENTION

In the manufacture of air impellers and other rotary fluid moving devices of molded plastic construction, hubs of metallic construction are frequently employed to provide a higher degree of structural integrity in the hub-shaft connection, e.g., as in better retention of set screws with stronger and more durable metallic threads. When metal hubs are inserted into the mold which produces the plastic part and thus molded in place in the air impeller or other device, the resulting product may be satisfactory with certain plastics and for certain applications but in other instances severe problems are encountered. More particularly, plastics with high shrinkage rates may result in a desirable end product but undesirably high levels of stress may occur in the plastic adjacent a metal hub inserted in the molding process. Further, and in the case of any plastic air impeller or like device provided with a metal hub during molding, there is an economic disadvantage. That is, the cycle time for the molding operation is increased by the time consumed in inserting the metal hub into the plastic mold and a resulting inefficiency and an increase in manufacturing costs is encountered.

SUMMARY OF THE INVENTION

It is the general object of the present invention to provide an improved hub construction for a rotary fluid moving device of molded plastic construction, the end product including a hub of metallic construction and yet the aforementioned disadvantages being wholly avoided.

BRIEF DESCRIPTION OF THE DRAWINGS

FIG. 1 is a front view of a rotary fluid moving device with an improved hub construction and which is constructed in accordance with the present invention.

FIG. 2 is a fragmentary enlarged front view of the hub construction.

FIG. 3 is a fragmentary enlarged sectional view of the hub construction of FIG. 2.

FIG. 4 is a fragmentary enlarged front view of an improved hub construction forming a second embodiment of the present invention.

FIG. 5 is a fragmentary enlarged sectional view of the hub construction of FIG. 4.

DESCRIPTION OF PREFERRED EMBODIMENTS

Referring particularly to FIGS. 1–3, it will be observed that a rotary fluid moving device indicated generally at 10 comprises a plurality of similar circumaxially arranged fluid moving blades 12, 12. At outer end portions the blades 12, 12 are formed integrally with a continuous peripheral member 14. The latter member may constitute a slinger ring when the fluid moving device is employed as an air impeller as in the form of the invention shown. At inner end portions, the blades 12, 12 are formed integrally with a central hub section indicated generally at 16 and which comprises a radial member 18, an axially projecting ring 20 connected with the blade inner ends, and a plurality of radially extending strengthening ribs 22, 22 on the member 18.

At a central portion, the member 18 has a somewhat thickened section 24 which serves as an inner or rear wall of a cylindrical hub cavity 26. The hub cavity 26 is further defined by a plurality of similar axially projecting flexible fingers 28, 28 formed integrally at rear or inner end portions with the member 18 or section 24 and arranged in a circumaxially spaced series to form a collet. Six fingers 28, 28 each of arcuate cross section are shown in the presently preferred embodiment of FIGS. 1–3. At forward or outer end portions the fingers 28, 28 have small inwardly projecting lips 30, 30 each with an inclined rear or inner surface 32. The rear or inner surfaces 32, 32 engage a complementary surface 34 at a forward or outer end portion of a metallic hub 36. As shown, the surfaces 32, 34 are inclined in a rearward or inner direction progressing radially outwardly from an inner edge of the lips 30, 30. As will be apparent, a hub 36 may be entered into the cavity 26 from right to left in FIG. 3 to the assembled position shown and in such position, the hub is retained axially between the rear wall 26 and the lip rear surfaces 32, 32 in engagement with the surface 34. Outward flexing of the fingers 28, 28 during entry of the hub may be aided by rounded surfaces 38, 38 at inner edges of the lips 30, 30 and which face generally outwardly or forwardly and by a similar rounded surface 40 at a rear portion of the hub.

The hub 36 may be of conventional metallic construction appropriately dimensioned to fit within the cavity 26 and provided with a central aperture 42 and a radially extending threaded aperture 44. The aperture 42 is for the introduction of a drive shaft such as illustrated at 46 in FIG. 3 and the threaded aperture 44 receives a conventional set screw as illustrated at 48. Further in a conventional manner, a flat 50 on the shaft 46 is engaged by an inner end surface of the set screw 48 whereby positively to secure the hub and shaft in assembled relationship.

Referring now particularly to FIG. 2, it will be observed that a gap 52 is provided in the fingers 28, 28 and opens radially outwardly. The said gap provides for the engagement of at least one edge surface thereof with the set screw 48 at an outer portion of the latter whereby to restrain the hub 36 against rotation relative to the fingers 28, 28. As shown, the gap 52 is approximately equal in arcuate extent to the diameter of the set screw 48 to provide for retention of the hub and restraint against relative rotation in both directions.

With the hub 36 entered in its cavity as illustrated, the fingers 28, 28 may be clamped radially inwardly into engagement therewith to retain the elements described in assembled relationship. That is, various clamping means may be employed and, in accordance with the invention, a clamping member is disposed about the fingers 28, 28 and extends through an angle of at least 180° with the clamping member engaging the fingers 28, 28 and exerting generally radially inward pressure thereon. As shown, a clamping ring 54 is employed and extends substantially throughout the circumferential outer surface of the fingers 28, 28. That is, the ring 54 which may be of a conventional spring metal type extends through approximately 360° except for the provision of a radially open gap 56 therein. The gap 56 is coextensive arcuately with the finger gap 52 and opens radially outwardly to receive an outer end portion of the set screw 48 with the elements in assembled position as shown. Thus, accidental or unintended relative rotation of the ring 54 about the fingers 28, 28 is positively prevented by the set screw 48.

Referring now to FIGS. 4 and 5, it will be observed that a second embodiment of the hub construction of the present invention comprises three circumaxially spaced axially projecting flexible fingers 58, 58. The fingers 58, 58 are similar to the fingers 28, 28 except for the provision of a partial end wall by means of radially inwardly projecting flange portions 60, 60 at outer or right-hand end portions of the fingers, FIG. 5. A central portion 62 of the impeller is provided with a circular aperture at 64 to accommodate the left-to-right entry of a hub 66 into a cylindrical hub cavity 68. Thus, axial movement of the hub in the right-hand direction is restrained by the partial end wall of the cavity formed by the projections 60, 60 and, in accordance with the presently preferred practice, a tongue and groove connection is provided for further restraint against axial dislodgment of the hub. Tongue sections or members 70, 70 on the fingers 58, 58 project radially inwardly and cooperate with an annular groove 72 formed in the hub 66. As will be apparent, left to right-hand introduction of the hub to the cavity 68 can be effected by the slight radial outward flexing of the fingers 58, 58 on engagement of an end portion of the hub with the tongue sections 70, 70. As the fingers flex outward and right-hand movement of the hub continues, the tongue sections 70, 70 snap into the groove 72 whereby to secure the hub in the cavity 68.

A shaft 74 for driving the hub and associated air impeller is provided with a flat 76 in a conventional manner and set screw 78 enters a suitably threaded radial opening 80 in the hub 66 and engages the flat for a positive hub-shaft connection. Further, and as best illustrated in FIG. 4, a gap 82 is provided in the fingers 58, 58 and is radially open for entry of the set screw 78 and for engagement of the set screw with edge portions of the fingers adjacent thereto. As described above, the set screw 78 thus serves the dual functions of hub-shaft connection and retention of the hub against relative rotation in its cavity 68.

As in the case of the above-described preferred embodiment of FIGS. 1–3, a clamping member is preferably employed for securing the elements in assembled positions and such member preferably takes the form of a clamping ring 84 of spring metal or the like. The clamping ring 84 is provided with a radially open gap 86 for receiving an outer end portion of the set screw 78 and for retaining the ring in fixed position relative to the fingers 58, 58.

In accordance with the method of the present invention, a rotary fluid moving device such as the air impeller 10 is molded in a conventional plastic molding process. The blades 12, 12 are thus formed together with a plurality of flexible axially projecting fingers such as the fingers 28, 28 or 58, 58. A cylindrical metallic hub such as the hubs 36, 66 is inserted in the cavity formed by the axial fingers and a clamping member such as the rings 54, 84 is engaged on and about the fingers whereby to exert radial inward pressure thereon and indirectly on the hub to secure the elements in assembled positions. As will be apparent, when the fingers are provided with retention means such as the lips 30, 30 and the tongue sections 70, 70 a degree of radial outward flexing of the fingers occurs during the axial inward insertion of the hub into position in its cavity. Thus, the hub is restrained axially and, on subsequent insertion of a drive shaft and the assembly therewith of a set screw, all elements are locked in position both axially and rotationally as described above.

Insertion of the hubs into their cavities can be accomplished by an operator of a molding machine together with the assembly of the clamping rings during lulls in the operator's activities. Thus, no additional labor time is required and the above-mentioned disadvantages of increased cycle time with metal insert hubs is avoided. Moreover, undesirably high stresses in the hub construction are wholly eliminated and a high degree of structural integrity is provided for in the finished product.

We claim:

1. A rotary fluid moving device of molded plastic construction and comprising a plurality of similar circumaxially arranged fluid moving blades and an associated central hub section, said hub section comprising a plurality of similar axially projecting flexible fingers formed integrally and arranged in a circumaxially spaced series to form a collet defining a cylindrical hub cavity, a cylindrical centrally apertured hub of metallic construction disposed in said cavity and adapted for positive connection with a drive shaft entered in its said central aperture, and an arcuate clamping member disposed about said fingers and extending at least through an angle of 180°, said clamping member engaging said fingers and exerting generally radial inward pressure thereon and indirectly on said hub for retention of the latter in said cavity.

2. A rotary fluid moving device as set forth in claim 1 wherein said fingers define at least one radially open gap, and wherein said hub is provided with a radially outwardly projecting set screw, said set screw providing the dual function of positively securing a drive shaft in said hub and at an outer end engaging at least one finger adjacent said gap and securing said hub against relative rotation in at least one direction in said cavity.

3. A rotary fluid moving device as set forth in claim 2 wherein said radially open gap extends through an arc approximately equal to the diameter of said set screw, said set screw oppositely engaging the fingers adjacent the gap whereby to secure the hub in its cavity against relative rotation in both directions.

4. A rotary fluid moving device as set forth in claim 3 wherein said clamping member has a radially open gap approximately coextensive with and aligned radially with said finger gap, said set screw being of sufficient length to project radially outwardly into said gap in said clamping member and to secure the same against unintended or accidental rotation relative to said fingers.

5. A rotary fluid moving device as set forth in claim 4 wherein six fingers are provided, wherein said hub cavity has a radial end wall opposite said fingers, and wherein each of said fingers is provided at an outer end portion with a radially inwardly projecting lip, said lips serving collectively to engage an outer end portion of a hub disposed in said cavity and to retain the same axially in cooperation with said cavity end wall.

6. A rotary fluid moving device as set forth in claim 1 wherein at least one of said fingers and said hub are provided with complementary abutment surfaces engageable with the hub disposed in its cavity to restrain the hub against axial movement relative to the fingers.

7. A rotary fluid moving device as set forth in claim 6 wherein said fingers and hub are provided with an annular tongue and groove axial retention means operative in both axial directions.

8. A rotary fluid moving device as set forth in claim 7 wherein said fingers have radially inwardly projecting outer end portions to provide at least a partial end wall for said hub cavity.

9. A rotary fluid moving device as set forth in claim 8 wherein three fingers are provided, wherein substantially coextensive radially open gaps are provided in said fingers and clamping member, and wherein a set screw is provided in said hub and projects radially outwardly into said gaps to lock the hub on a drive shaft and to secure said hub, fingers, and clamping member rotationally.

10. A rotary fluid moving device as set forth in claim 1 wherein said clamping member takes the form of a spring metal clamping ring.

* * * * *